US011083934B2

(12) United States Patent
Steck et al.

(10) Patent No.: US 11,083,934 B2
(45) Date of Patent: Aug. 10, 2021

(54) CAMMING RETRACTION SYSTEM

(71) Applicants: Jeremy Steck, Salt Lake City, UT (US); Garrett Harmsen, Salt Lake City, UT (US); Brent Barghahn, Salt Lake City, UT (US); Jacob Hall, Midway, UT (US)

(72) Inventors: Jeremy Steck, Salt Lake City, UT (US); Garrett Harmsen, Salt Lake City, UT (US); Brent Barghahn, Salt Lake City, UT (US); Jacob Hall, Midway, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 0 days.

(21) Appl. No.: 16/858,975

(22) Filed: Apr. 27, 2020

(65) Prior Publication Data

US 2020/0346075 A1 Nov. 5, 2020

Related U.S. Application Data

(60) Provisional application No. 62/840,537, filed on Apr. 30, 2019.

(51) Int. Cl.
*A63B 29/02* (2006.01)

(52) U.S. Cl.
CPC ..... *A63B 29/024* (2013.01)

(58) Field of Classification Search
CPC ..... A63B 29/024
See application file for complete search history.

(56) References Cited

U.S. PATENT DOCUMENTS

| | | | |
|---|---|---|---|
| 4,832,289 | A | 5/1989 | Waggoner |
| 4,923,160 | A | 5/1990 | Waggoner |
| 5,860,629 | A | 1/1999 | Reed |
| 6,042,069 | A | 3/2000 | Christianson |
| 6,375,139 | B1 | 4/2002 | Tucker |
| 6,679,466 | B2 | 1/2004 | Brown |
| 6,736,359 | B2 | 5/2004 | Murray |

(Continued)

FOREIGN PATENT DOCUMENTS

| | | |
|---|---|---|
| DE | 10131854 A1 | 5/2003 |
| GB | 2419632 | 3/2006 |

*Primary Examiner* — Anita M King
(74) *Attorney, Agent, or Firm* — Trent Baker; Baker IP PLLC

(57) ABSTRACT

One embodiment relates to an improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The retraction system is configured to selectively engage the retracted state with a trigger assembly which is slidably externally coupled to the connection system. The trigger assembly further includes a coupling member coupled with the plurality of cam lobes via a plurality of retractor wires, at least one trigger cable fixably coupled to the coupling member, a trigger coupled to the at least one trigger cable, a sleeve member intercoupled between the coupling member and the trigger.

20 Claims, 18 Drawing Sheets

(56) References Cited

U.S. PATENT DOCUMENTS

| | | | | |
|---|---|---|---|---|
| 7,014,156 | B2 | 3/2006 | Apezetxea | |
| 7,140,583 | B2 | 11/2006 | Petzl | |
| 7,278,618 | B2 | 10/2007 | Tusting | |
| 7,802,770 | B2 | 9/2010 | Field | |
| 2004/0035992 | A1* | 2/2004 | Watts | A63B 29/024 248/231.9 |
| 2005/0218282 | A1 | 10/2005 | Phillips | |
| 2013/0334385 | A1* | 12/2013 | Steck | A63B 29/024 248/231.9 |
| 2018/0001175 | A1* | 1/2018 | Davidson | A63B 69/0048 |

* cited by examiner

CAMMING RETRACTION SYSTEM

RELATED APPLICATIONS

This application claims priority to U.S. provisional application Ser. No. 62/840,537 filed Apr. 30, 2019, the contents of which are incorporated by reference.

FIELD OF THE INVENTION

The invention generally relates to active camming systems. In particular, the present invention relates to an improved camming stem system.

BACKGROUND OF THE INVENTION

Climbers generally use clean protection devices for two distinct purposes. First, a clean protection device may be used as a form of safety protection for protecting a climber in the event of a fall, and second, a clean protection device may intentionally be used to artificially support a climber's weight. Clean protection devices cam or wedge into a crack, hole, gap, orifice, taper, or recess in order to support an outward force. The surface on which the clean protection device supports the outward force is considered the protection surface. The protection surface can consist of natural materials such as rock or may consist of artificial materials such as concrete or wood.

Clean protection devices are generally divided into categories of active and passive. Passive protection devices include a single object which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable parts that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection is camming devices. These devices translate rotational displacement into linear displacement. Therefore, a slider chock would not be an active camming device because the two wedges simply slide relative to one another and do not rotate. Camming devices may include two, three, and four cam lobes. The cam lobes on an active camming device are generally spring biased into an expanded position and are able to rotate or pivot about an axle in order to retract. In operation, at least one cam lobe on either side of the unit must make contact with the protection surface for the device to be able to actively support an outward force. Some active protection devices can also be used passively to support outward forces as well.

Unfortunately, the largest disadvantages of lightweight active protection devices are lack of stem rigidity during retraction and lack of stem flexibility during extension. The connection system connects the camming objects to some form of clip-in point or loop. The two most common connection systems used in three and four lobe cam units are single stem and double stem systems. Double stem systems include a U-shaped cable that attaches independently to two cable terminals on either end of the head of the protection device. The clip-in point of a double stem system is simply the bottom of the U-shaped cable. Single stem systems include a single cable that is attached to a single cable terminal located at the center of the head of the protection device. The single stem system generally includes some form of clip-in loop attached to the single cable. Alternatively, a clip-in loop can be created by coupling the single cable back to itself with some form of swage. Single stem connection systems are generally preferable because they are less likely to obstruct the placement of the camming device. However, one of the problems with single stem connection systems is a lack of sufficient rigidity when selectively switching between an extended state and a retracted state, and a lack of stem flexibility in the extended operational state.

Therefore, there is a need in the industry for active camming stem systems that increase the stem rigidity for optimal use during retraction while optimizing flexibility in the extended state during operation.

SUMMARY OF THE INVENTION

The present invention relates to active camming systems. One embodiment of the present invention relates to an improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The retraction system is configured to selectively engage the retracted state with a trigger assembly which is slidably, externally coupled to the connection system. The trigger assembly further includes a coupling member coupled with the plurality of cam lobes via a plurality of retractor wires, at least one trigger cable coupled to the coupling member, a trigger coupled to the at least one trigger cable, a sleeve member intercoupled between the coupling member and the trigger, wherein the at least one trigger cable is disposed within the sleeve member.

Embodiments of the present invention represent a significant advancement in the field of single stem active camming systems. Conventional single stem camming systems generally include one or more undesirable characteristics to provide the necessary coupling and functionality. A metal rigid stem or over tube creates rigidity during retraction, but it adds significant weight to the system and is not optimally flexible in the extended state. An exposed single flexible cable creates flexibility in the extended state but often fails to provide optimal rigidity during retraction. Embodiments of the present invention incorporate a novel use of a trigger assembly which is releasably coupled to the trigger rather than fixably coupled. The trigger assembly further includes at least one trigger cable within a sleeve member. The unique coupling scheme and components of the trigger assembly create a temporary rigidity in the retracted state while providing an optimal stem flexibility in the extended state.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to active camming systems. One embodiment of the present invention relates to an improved camming stem system including a head member, a plurality of cam lobes, a connection system, and a retraction system. The cam lobes may be selectively rotatable between an extended state and a retracted state with respect to at least one axle of the head member. The connection system may create an elongated, substantially rigid region by intercoupling the head member with a loop. The retraction system is configured to selectively engage the retracted state with a trigger assembly which is slidably, externally coupled to the connection system. The trigger assembly further includes a coupling member coupled with the plurality of cam lobes via a plurality of retractor wires, at least one trigger cable coupled to the coupling member, a trigger coupled to the at least one trigger cable, a sleeve member intercoupled between the coupling member and the trigger. The at least one trigger cable is disposed within the sleeve member. Also, while embodiments are described in reference to a single stem active camming system, it will be appreciated that the teachings of the present invention are applicable to other areas, including but not limited to other camming systems.

Reference is initially made to FIGS. 1-6 and 7-12, which illustrate complete and cross-sectional perspective views of two embodiments of a single stem active camming system 100 in the extended and retracted states, respectively.

Figure 1:
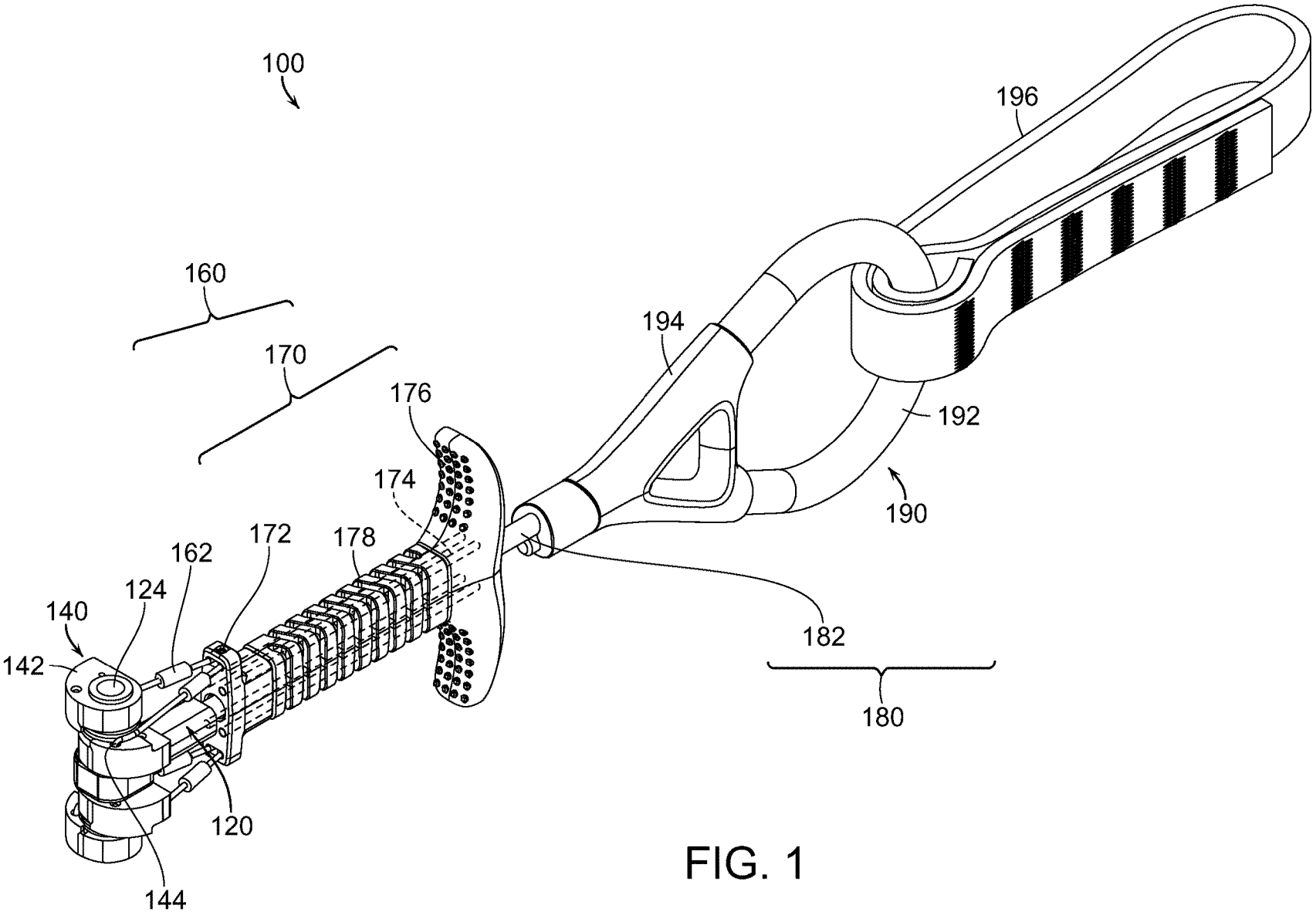
FIG. 1 illustrates a perspective view of a single cable stem active camming system in an extended state in accordance with embodiments of the present invention.
Figure 2:
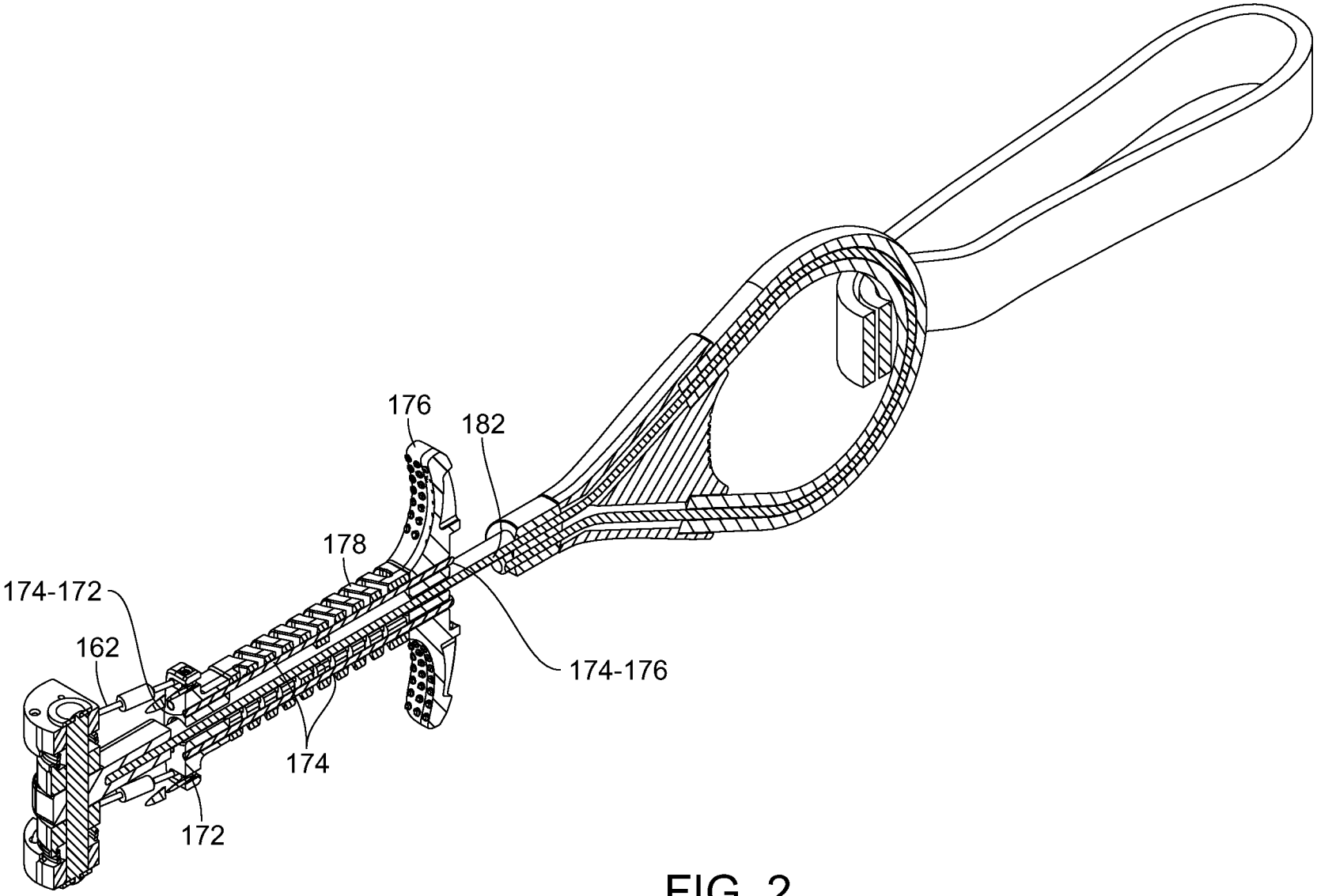
FIG. 2 illustrates a cross-sectional perspective view of a single cable stem active camming system in an extended state in accordance with embodiments of the present invention.
Figure 3:
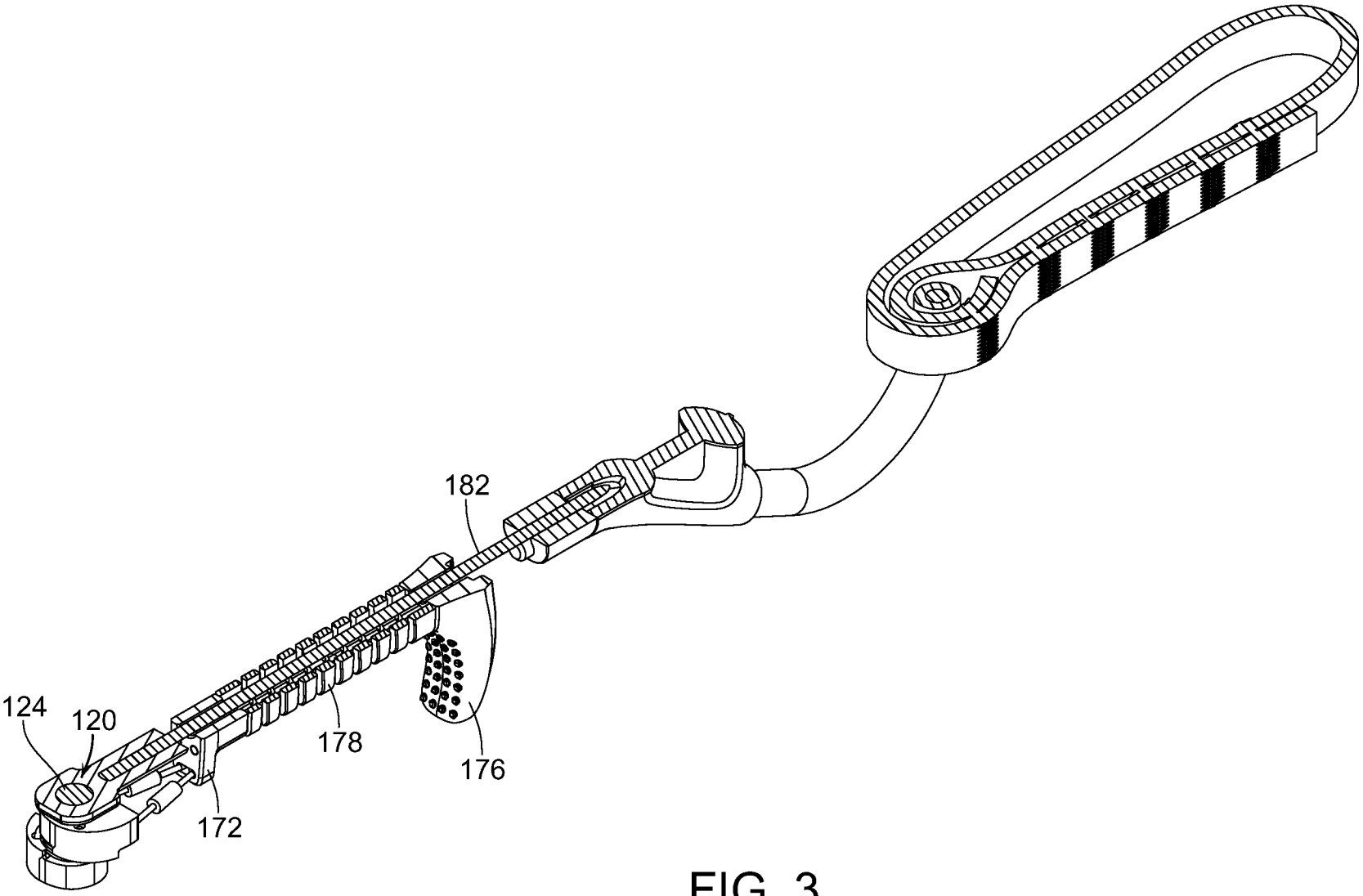
FIG. 3 illustrates an alternative cross-sectional perspective view of a single cable stem active camming system in an extended state in accordance with embodiments of the present invention.
Figure 7:
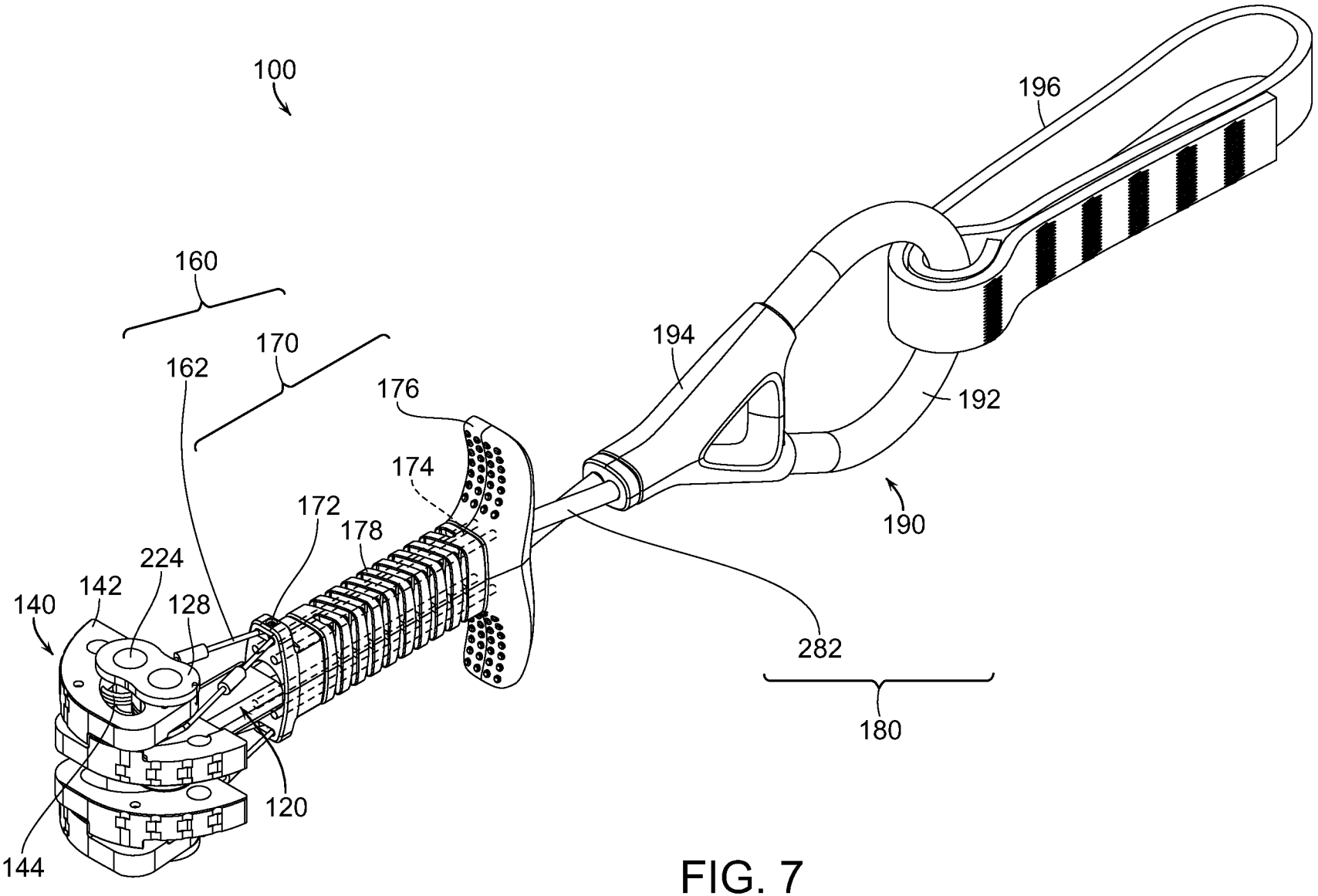
FIG. 7 illustrates a perspective view of a double cable stem active camming system in an extended state in accordance with embodiments of the present invention.
Figure 8:
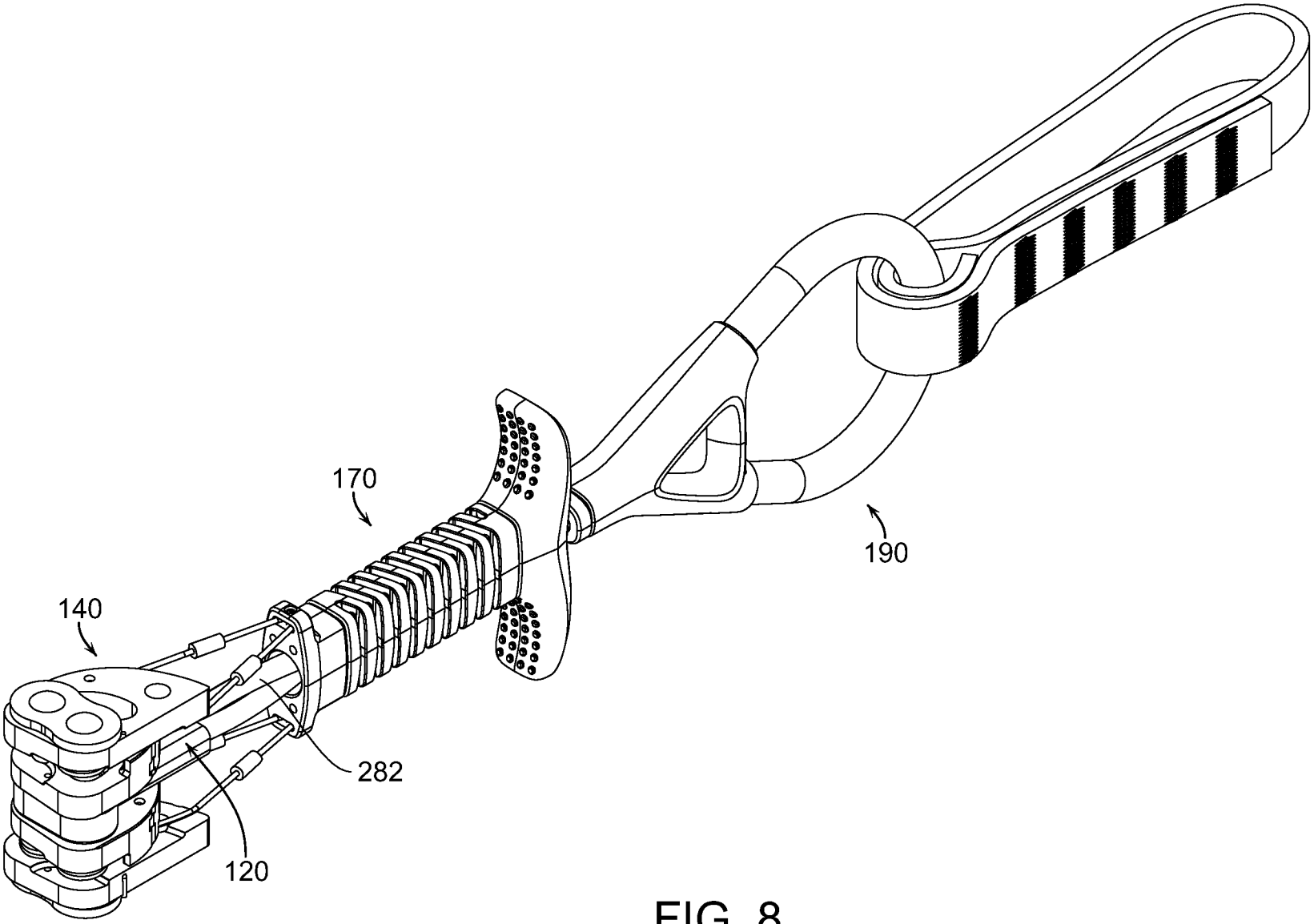
FIG. 8 illustrates a perspective view of a double cable stem active camming system in a retracted state in accordance with embodiments of the present invention.

FIGS. 1 and 7 illustrate the perspective views of the two active camming systems, incorporating concepts of the present invention. The system(s) 100 includes a head member 120, cam lobes 140, a retraction system 160, and a connection system 180. The cam lobes 140 further includes a set of lobes 142 and a set of biasing springs 144. The head member 120 further includes an axle 124/224 (or 2 axles), a head (See FIGS. 3 and 9), and a set of plates or axle separators 128 (FIG. 7, dual axle embodiment). The axle(s) 124/224 are cylindrical members which facilitate the rotation of the lobes 142 between extended and retracted states (FIGS. 1 and 7 extended, FIGS. 4 and 10 retracted, respectively). The axle(s) 124/224 may comprise a rigid metal material configured to withstand particular forces. The embodiment illustrated in FIGS. 1-6 includes one axle 124, while the embodiment in FIGS. 7-12 includes two axles 224. The optional plates 128 rigidly intercouple the end regions of the axles 224 so as to create a particular spacing therebetween. The plates 128 are disposed on either side of the head member 120 in the double axle 224 embodiment illustrated in FIGS. 7-12. The plates 128 may be composed of a metal such as steel or aluminum and may be shaped in an oval configuration. The head (FIG. 3) is configured to at least partially cover a coupling region of the axle 124/224 between the lobes 142 and to resist translation and rotation of the axles 124/224. The head may be substantially T-shaped and composed of a rigid plastic or metal material (FIG. 3).

The cam lobes 140 include independent lobes 142 and biasing springs 144. It will be appreciated that alternative embodiments may include other lobe configurations, including but not limited to two or three lobe systems (not shown). The lobes 142 are rotatably coupled to the axles 124/224 to facilitate rotation between the extended and retracted states (i.e. axis of rotation). The lobes 142 are each substantially quarter circle-shaped with a curved camming surface and are configured to rotate about a rotation point mathematically corresponding to the shape of the curved camming surface. The lobes 142 may be composed of a metal material including but not limited to aluminum, and may incorporate various internal recesses, depressions, etc. The lobes 142 are biased in the extended state with respect to the axles 124/224 with the biasing springs 144, meaning that in the absence of selective user forces, the lobes 142 and system 100 will engage the extended state. The biasing springs 144 are intercoupled between the lobes 142 and the axles 124/224.

The retraction system 160 is coupled between the connection system 180 and the cam lobes 140 and is configured to enable the selective engagement of the retracted state (FIGS. 4 and 8) from the default/biased extended state. The retraction system 160 includes a set of retraction wires 162 and a trigger assembly 170. The trigger assembly 170 is slidably coupled over the cable 182/282 of the connection system 180 and will be discussed in more detail below. The embodiment illustrated in FIGS. 1-6 includes a single cable 182 coupled to the head of the head member 120 and looped around and coupled via a swage at the Y-shaped thumb rest 194 region. In contrast, the embodiment illustrated in FIGS. 7-12 includes a single cable 282 that is coupled at both ends to the head (clearly shown in the cross-section of FIG. 9). The trigger assembly 170 includes a trigger 176 shaped to include two finger regions orthogonally extending from the elongated region of the connection system 180. The trigger 176 may be composed of a rigid plastic material. The trigger assembly 170 further includes at least one trigger cable 174 and coupling member 172. The trigger cable(s) 174 are coupled to the individual lobes 142 via the coupling member 172 and the plurality of retraction wires 162. The trigger assembly 170 further includes a sleeve member 178 slidably coupled over the cable 182/282 and substantially encasing the trigger cable(s) 174. Although the illustrated embodiments includes a specific type of retraction system 160, it will be appreciated that the teaching of the present invention may be implemented with other non-illustrated retraction systems such as the embodiments discussed below in reference to FIGS. 13-18; the alternative retraction systems include various types of trigger assemblies and retraction wire configurations. The trigger assembly 170 is configured to slide along the elongated region of the connection system 180 corresponding to the extended and retracted states of the lobes 142. In operation, a user may retract the trigger 176 away from the head member 120 to overcome the biasing force of the cam lobes 140 from the extended state. As the user continues to retract the trigger 176, the intervening components and couplings cause the lobes 142 to rotate about the axle(s) 124/224 toward the retracted state.

The connection system 180 includes a cable 182/282 forming an elongated stem region and a loop 190. As discussed above, the cable 182/282 may be either coupled to the head 126 at both ends 184 (FIGS. 7-12) or coupled at the Y-shaped thumb rest 194 region between the loop and the elongated region (FIGS. 1-6). The components of the connection system 180 function synergistically to provide the structural integrity and flexibility for optimal operation of the retraction system. The cable 182/282 is flexibly biased toward an elongated straight configuration as shown. The cable 182/282 may optionally route through a Y-shaped or V-shaped thumb rest 194 channel in which two portions of the cable 282 are initially separated at the intersection of the elongated region and the loop 190. A portion of the cable 182/282 forms the loop 190 within an optional U-shaped cover member 192. The optional U-shaped cover member 192 may assist in forming the loop 190 and protecting the loop portion of the cable 182/282 during operation. The cable 182/282 is disposed within an internal channel of the optional U-shaped cover member 192 and Y-shaped thumb rest 194 members. An optional sling 196 may be attached to the loop 190 as illustrated.

Reference is next made to FIGS. 2-6 and 8-12, which illustrate various cross-sectional perspective views of the single stem active camming system 100 of the embodiments illustrated in FIGS. 1 and 7, respectively. FIGS. 2, 5, 9, and 10 illustrate vertical cross-sections of the extended and retracted states, while FIGS. 3, 6, 11, and 12 illustrate horizontal cross-sections of the extended and retracted states. The cross-sectional figures illustrate embodiments of the cable 182/282 forming the loop 190 and coupling with the head member 120. The orientation of the cable 182/282 creates the unique functionality that results in the optimal lengthwise rigidity and flexibility of the connection system 180 for operation of the retraction system 160.

Figure 9:
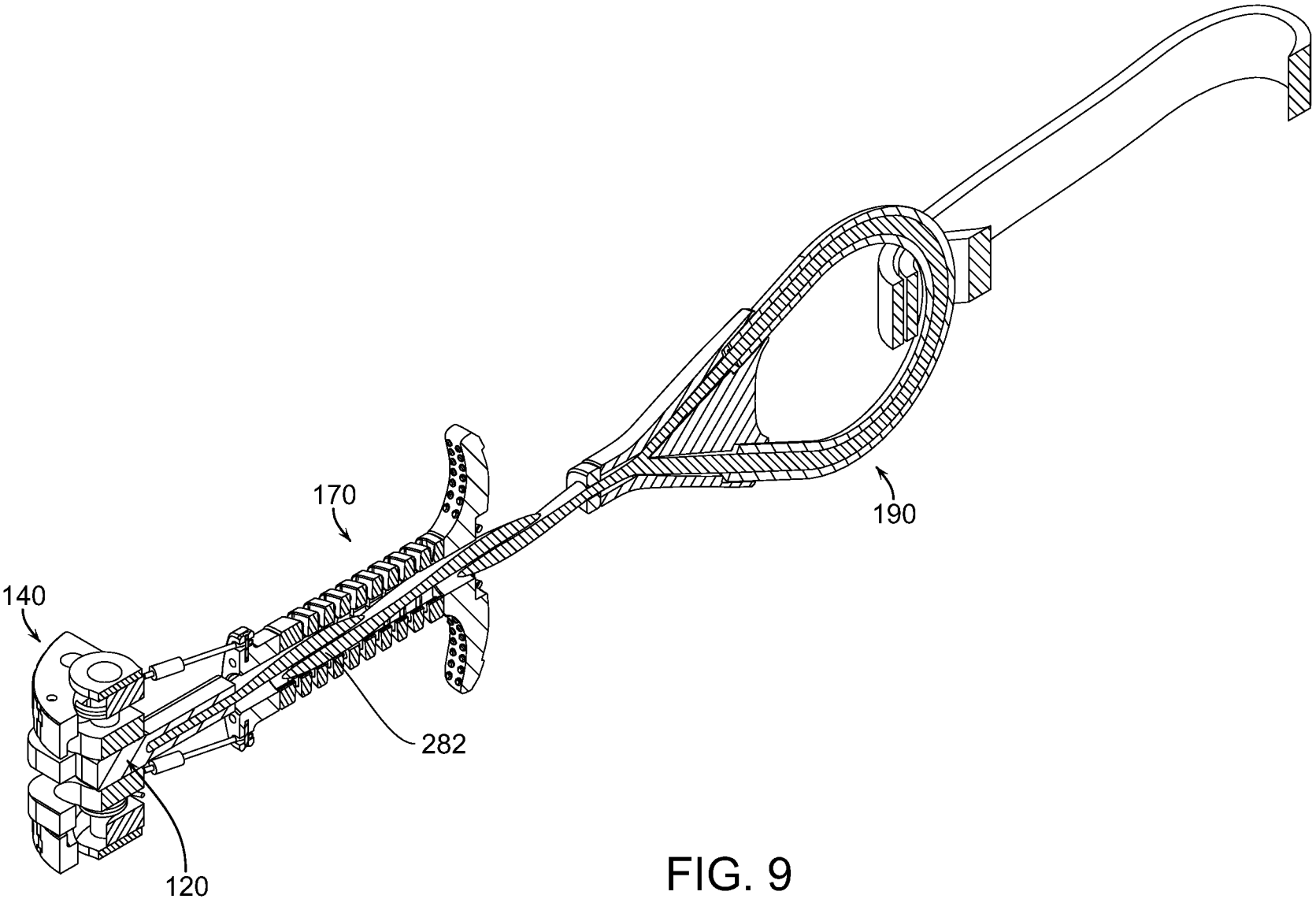
FIG. 9 illustrates a cross-sectional perspective view of a double cable stem active camming system in an extended state in accordance with embodiments of the present invention.
Figure 10:
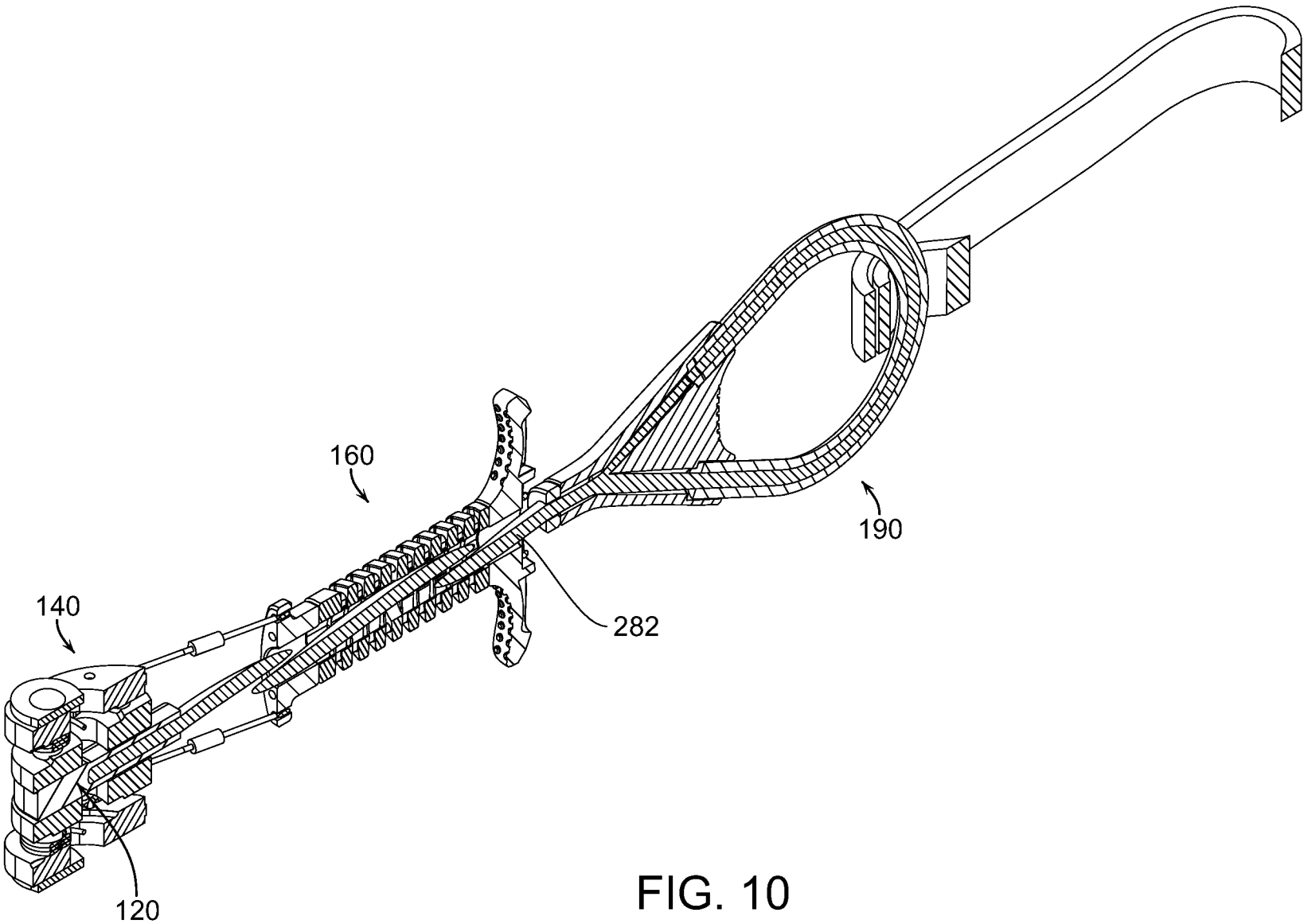
FIG. 10 illustrates a cross-sectional perspective view of a double cable stem active camming system in a retracted state in accordance with embodiments of the present invention.
Figure 11:
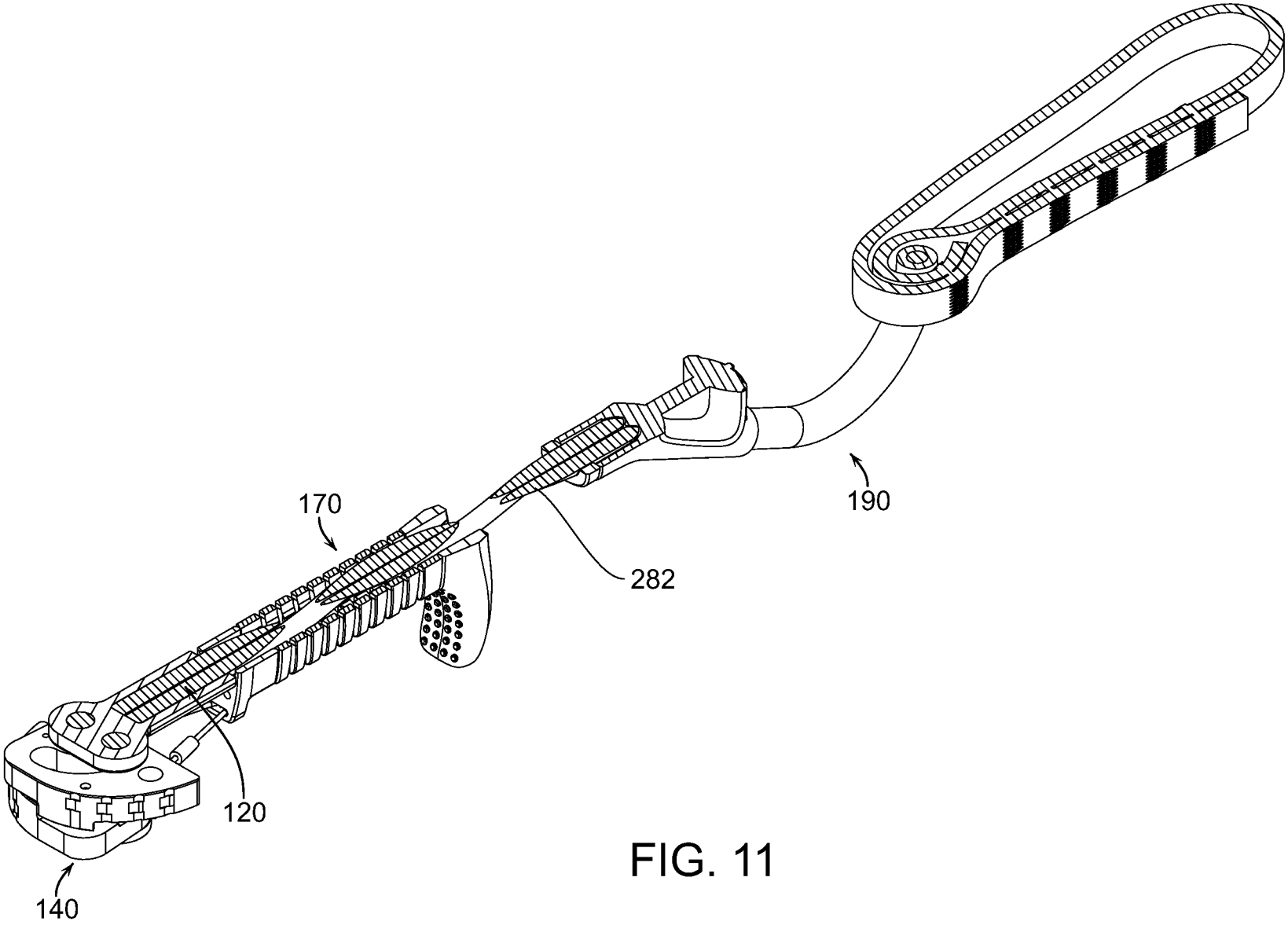
FIG. 11 illustrates an alternative cross-sectional perspective view of a double cable stem active camming system in an extended state in accordance with embodiments of the present invention.
Figure 12:
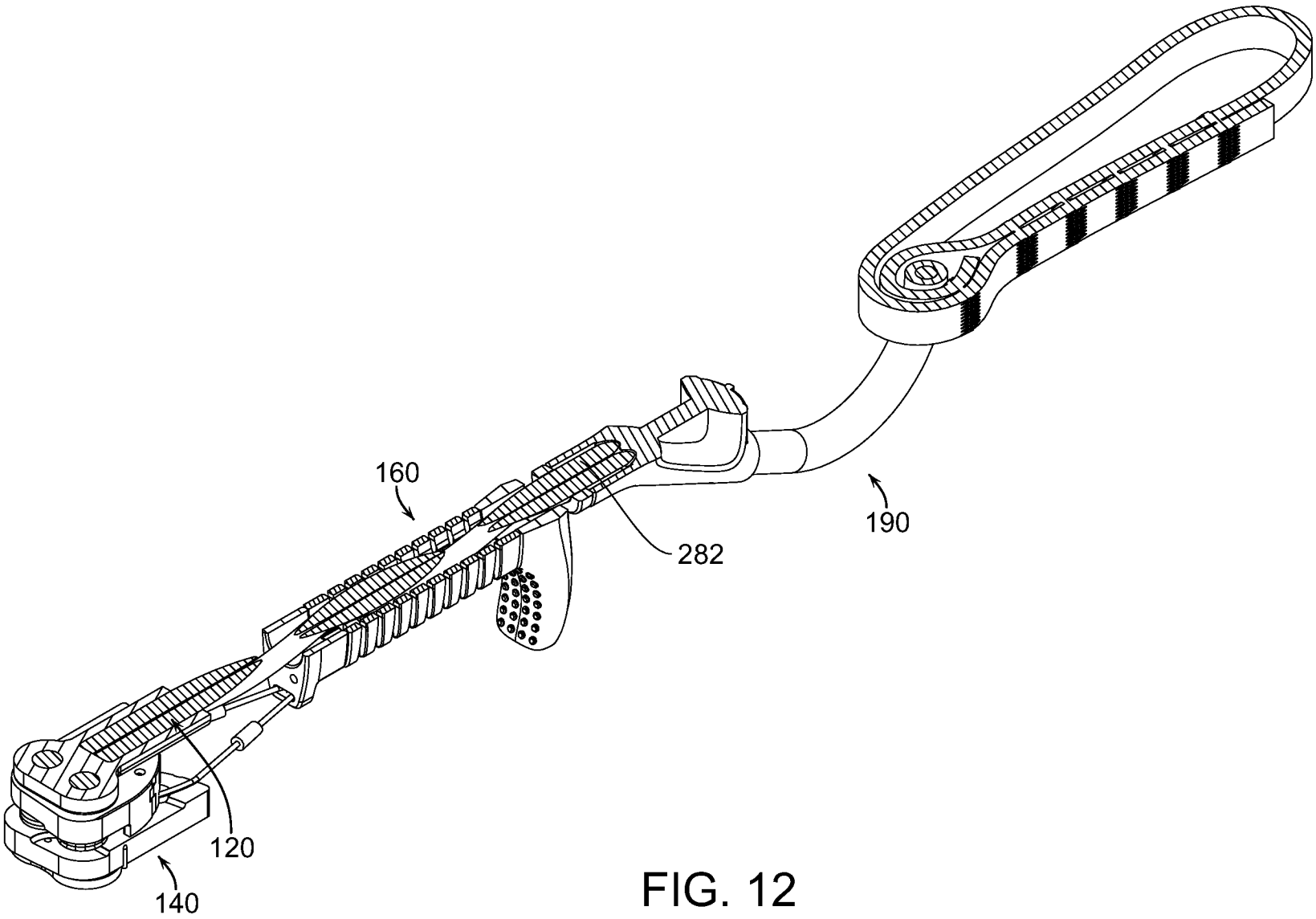
FIG. 12 illustrates an alternative cross-sectional perspective view of a double cable stem active camming system in a retracted state in accordance with embodiments of the present invention.

The novel retraction system 160 of the present invention includes the unique trigger assembly 170 and associated intercouplings with the head member 120, retraction wires 162, and cable 182/282 of the connection system 180. In particular, the trigger assembly 170 includes a novel releasable or slidable coupling between the trigger cables 174 and the trigger 176 (see FIG. 2 designated 174-176), which facilitate the overall system flexibility in the extended state. Likewise, the novel releasable coupling or slidable coupling between the trigger cables 174 and the trigger 176 facilitate the overall system rigidity in the retracted state (and during the transition to the retracted state from the extended state). This unique scheme facilitates the optimal operational performance of the system 100. The cross-sectional views of FIG. 2 and FIG. 9 illustrate the unique coupling scheme and structure of the trigger assembly 170, which facilitates the optimal flexibility in the extended state and rigidity in the retracted state. In particular, the trigger assembly 170 includes a coupling member 172, a sleeve member 178, a trigger 176, and at least one trigger cable 174. The coupling member 172 is coupled to the lobes 142 via a plurality of retraction wires 162. The coupling between the coupling member 172 and the retraction wires 162 may be either fixed or releasable in accordance with alternative embodiments. To facilitate the optional releasable coupling, the retraction wires 162 may be routed through and capped or looped through the coupling member 172. Alternatively, the retraction wires 162 may be fixably coupled directly to the coupling member 172. It will be appreciated that the retraction wires 162 may be composed of cable, webbing, wire, or other materials with a relatively high tensile strength.

Figure 4:
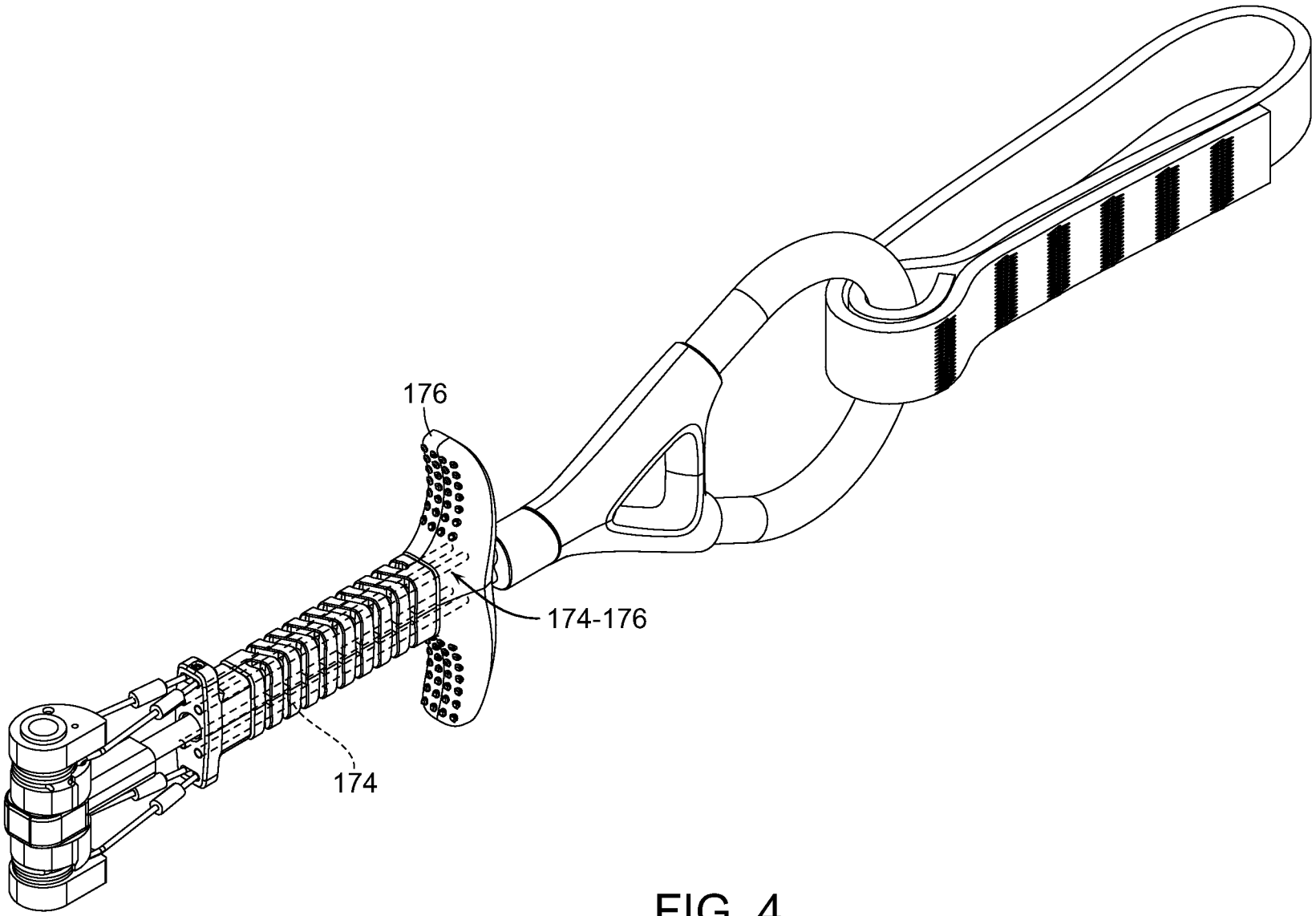
FIG. 4 illustrates a perspective view of a single cable stem active camming system in a retracted state in accordance with embodiments of the present invention.
Figure 5:
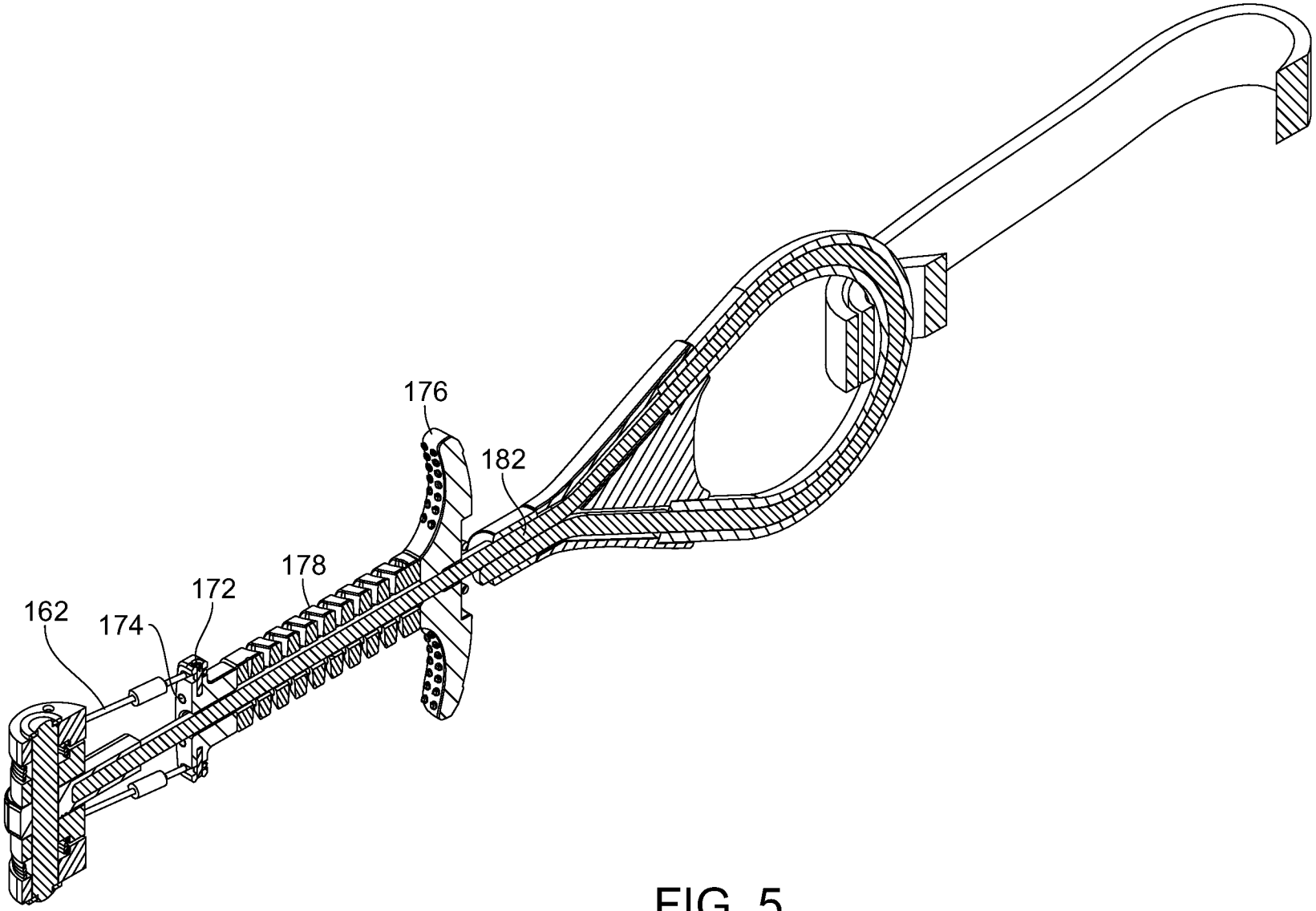
FIG. 5 illustrates a cross-sectional perspective view of a single cable stem active camming system in a retracted state in accordance with embodiments of the present invention.
Figure 6:
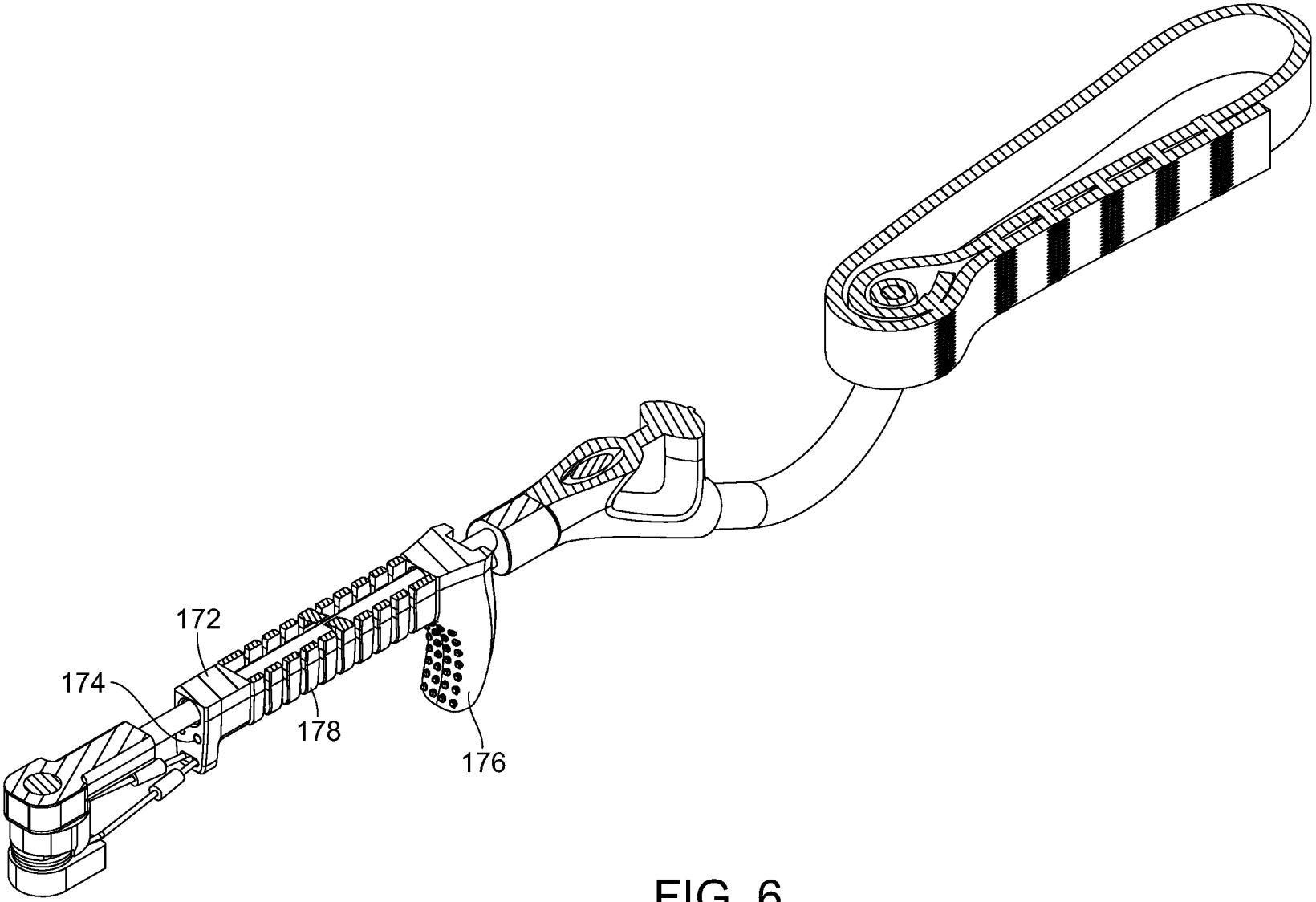
FIG. 6 illustrates an alternative cross-sectional perspective view of a single cable stem active camming system in a retracted state in accordance with embodiments of the present invention.

The trigger cable(s) 174 are coupled to the coupling member 172 substantially between the retraction wires 162 and the cable 182/282 and within the sleeve member 178 (see FIG. 2 designated 174-172). The coupling between the trigger cable(s) 174 and the coupling member 172 may be either fixed or releasable in the same manner as the retraction wires 162 discussed above. The sleeve member 178 will inherently be coupled to the coupling member 172 as a result of the length and tension of the trigger cables 174 intercoupling with the trigger 176. The illustrated sleeve member 178 shown in the embodiments of FIGS. 1-12 may be composed of a flexible rubber or plastic material with orthogonal slits to further facilitate flexibility in the extended state. In particular, a unique helix slit configuration of the sleeve member 178 has been found to optimize performance. The trigger cable(s) 174 are routed within the sleeve member 178 for protection and reliability. The sleeve member 178 is uniquely coupled to the trigger 176 via an essential releasable coupling. The trigger 176 is therefore inherently coupled to the sleeve member 178 as a result of the length and tension of the sleeve cables 174 intercoupling with the coupling member 172 and the trigger 176. The unique releasable coupling of the trigger cable(s) 174 with the trigger 176 may be facilitated by routing the trigger cable(s) 174 through a portion of the trigger 176 and capping the ends or looping a set of cables through the trigger 176 (see FIG. 4 designated 174-176). It will be appreciated that various other releasable coupling schemes may be used in accordance with alternative embodiments of the present invention. The routing and capping releasable coupling may include routing a single end of a trigger cable 174 through a recess in the trigger 176 and then swaging some type of cap to act as a chock against the recess of the trigger 176 (see FIG. 15). The nature of the releasable coupling between the trigger cable(s) 174 and the trigger 176 creates a lengthwise rigidity only when the trigger 176 is retracted toward the loop 190 (FIG. 4). When the trigger 176 is retracted, the opposing lengthwise forces within the trigger assembly 170 resist bending along the elongated region of the stem or connection system 180. The lengthwise rigidity effectively stiffens the stem, preventing undesirable bending when a user selectively retracts the trigger 176 to engage the retracted state. Embodiments may include various numbers of trigger cables 174 to effectuate different levels of rigidity in the retracted state. For example, four trigger cables 174 may be substantially equally radially separated with the sleeve member 178 around a stem region to cause a 360 degree rigidity. Likewise, two or three trigger cables 174 may be specially oriented radially to effectuate desired degrees of rigidity in specific three-dimensional orientations.

The trigger cables 174 may be coupled to the sleeve member 178 to prevent the trigger cables 174 from buckling when the trigger 176 is bent out of plane. If the trigger cables 174 are allowed to buckle, they fail to provide rigidity in the retracted state. Therefore, to prevent buckling, the sleeve member 178 must be slidably coupled to the trigger cables 174. This releasable coupling may include a chock type coupling and/or a bead or an eyelet attached to the cable 182/282. To avoid buckling, the system 100 must include at least two flexible trigger cables 174 that interconnect the coupling member 172 to the trigger 176. The trigger cables 174 may also be substantially equidistantly radially spaced (i.e. if there are two cables, they are spaced about 180 degrees from one another). The flexible trigger cables 174 function as tensile members in the retracted state but remain flexible and provide less rigidity in the extended state. The illustrated embodiment with two trigger cables 174 in the retracted state creates a rigidity along the plane through the axes of the two trigger cables 174 but not in a plane orthogonal to that plane.

Figure 13:
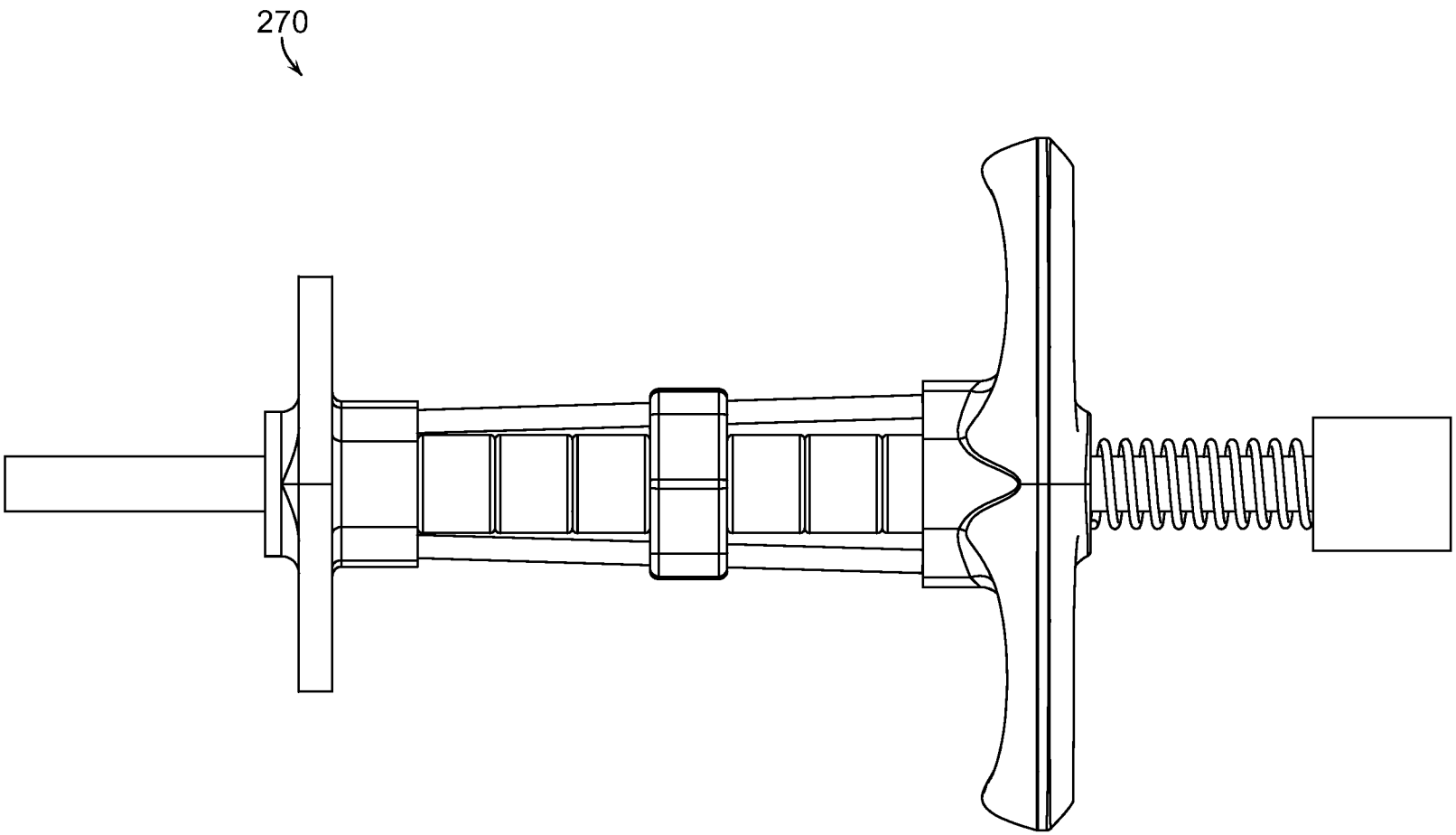
FIG. 13 illustrates an alternative 2-way bead trigger assembly embodiment.
Figure 14:
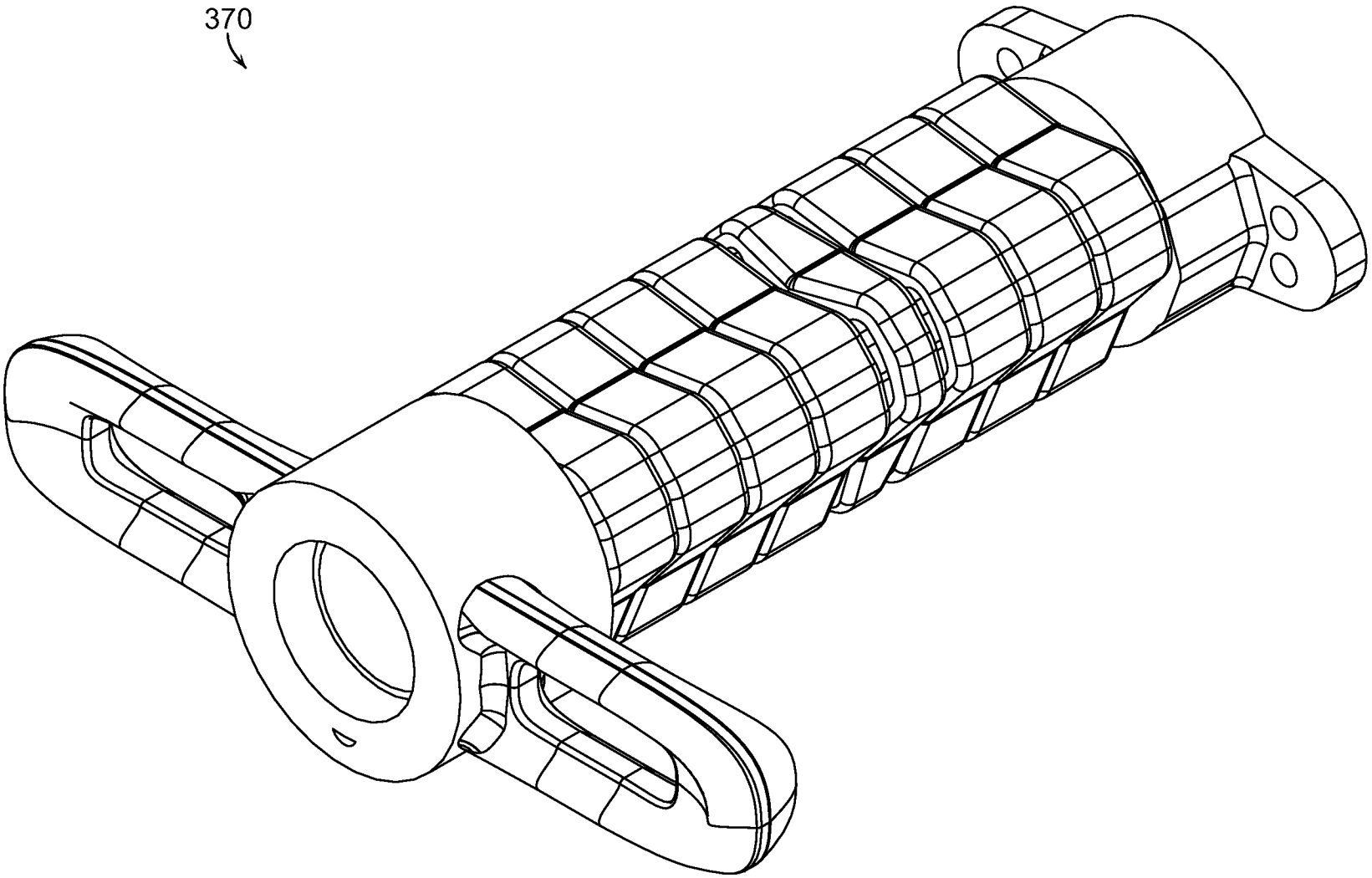
FIG. 14 illustrates an alternative 3-way bead trigger assembly embodiment.
Figure 15:
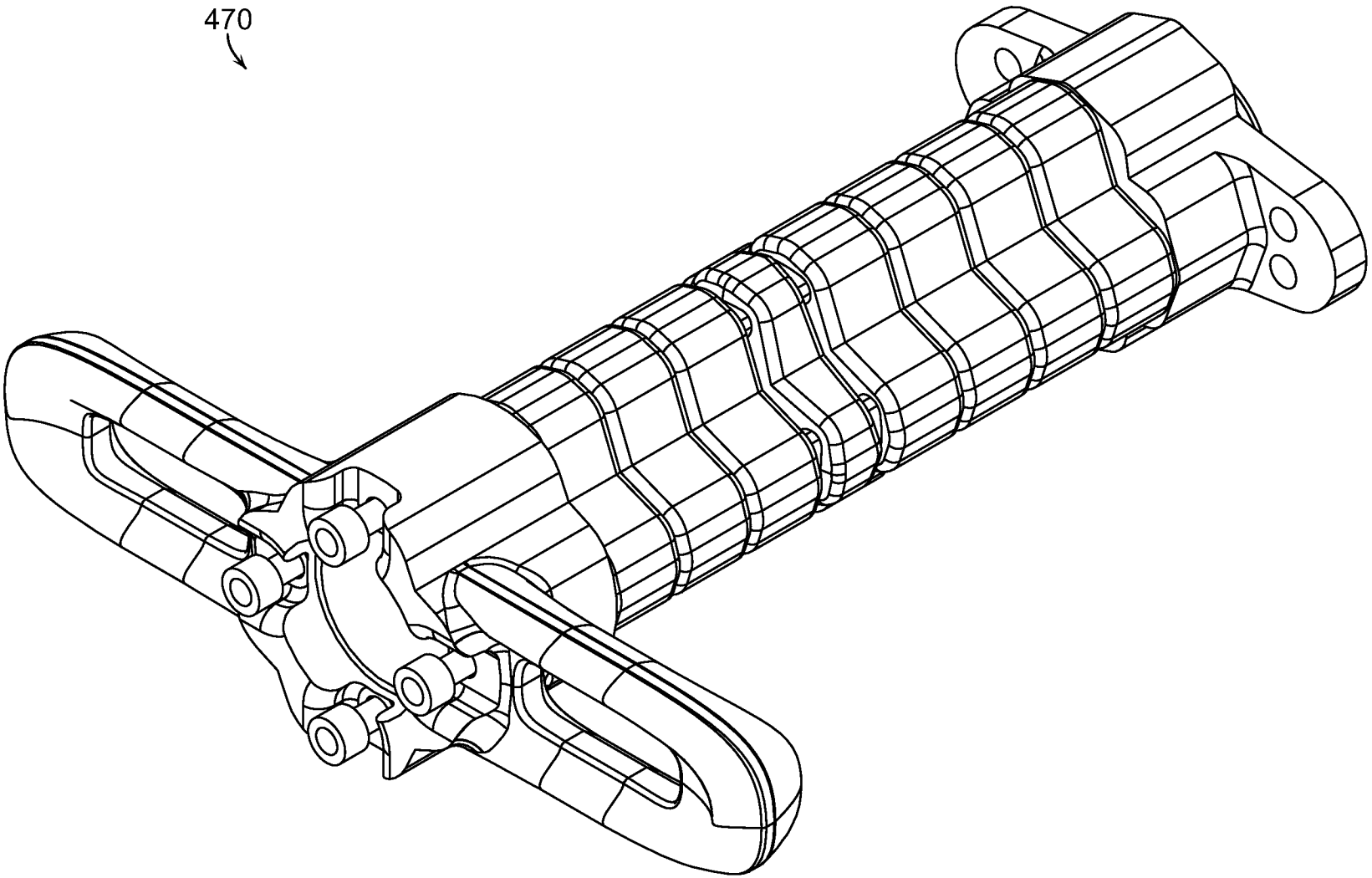
FIG. 15 illustrates an alternative 4-way trigger assembly embodiment.
Figure 16:
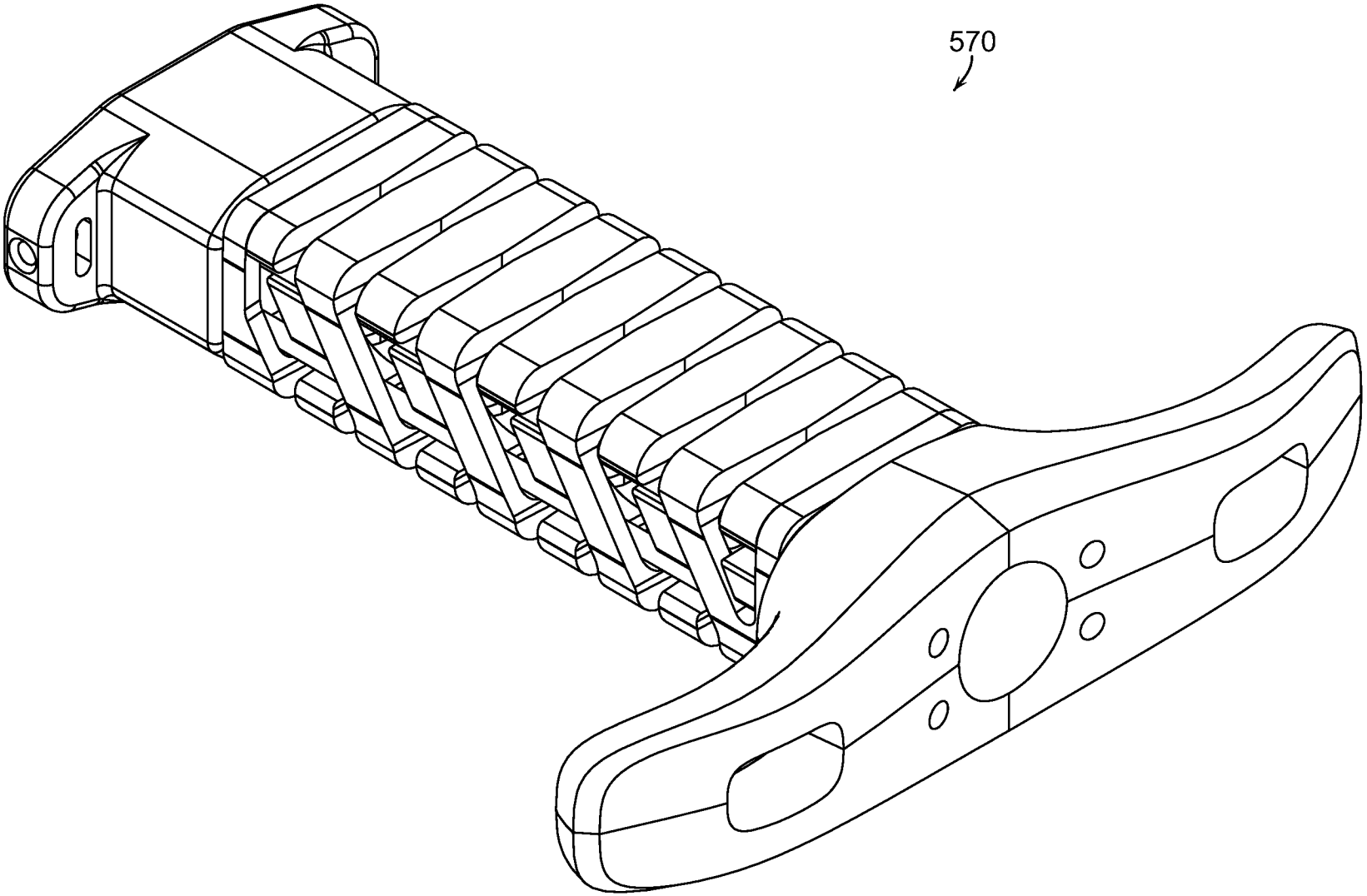
FIG. 16 illustrates an alternative double helix trigger assembly embodiment.
Figure 17:
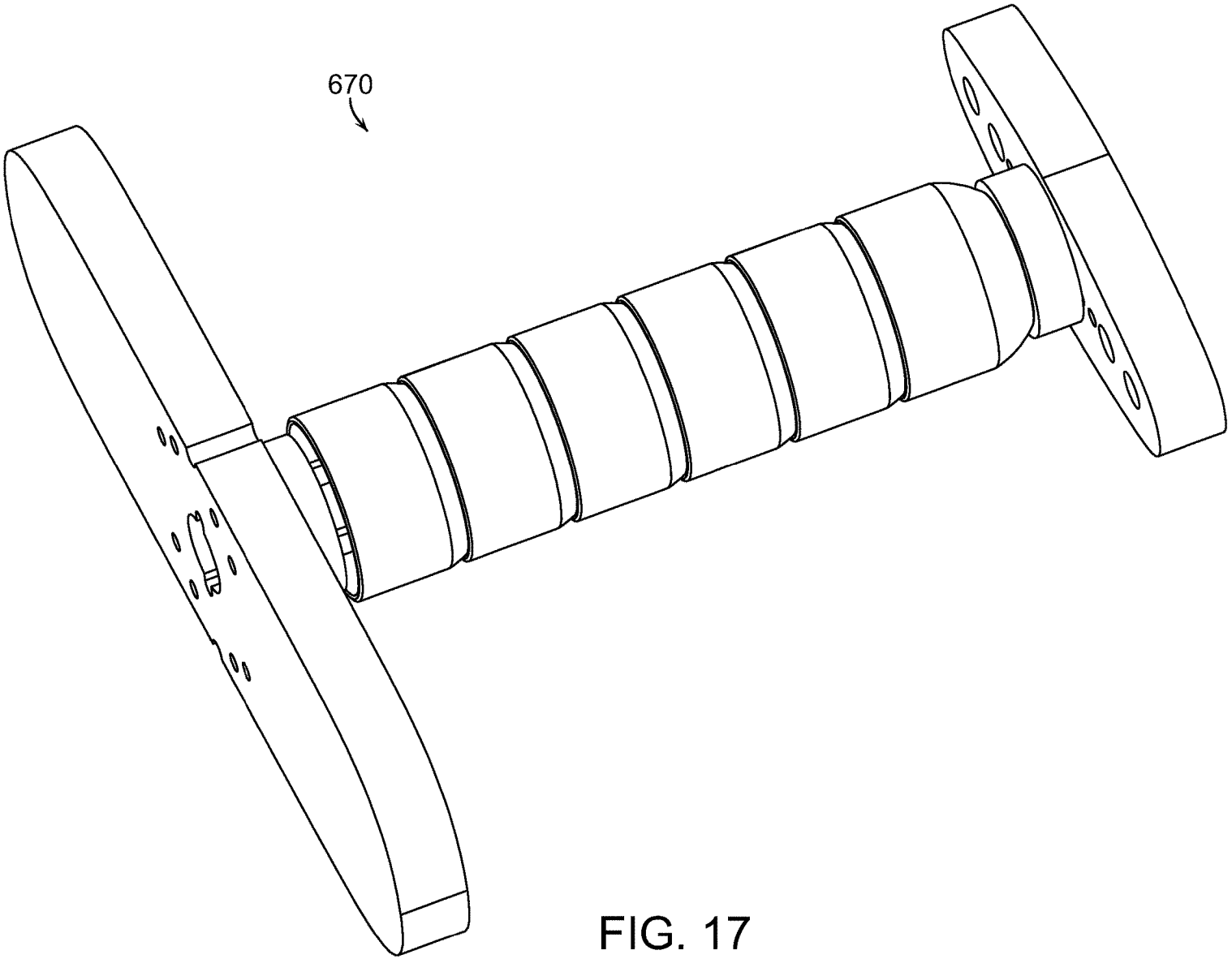
FIG. 17 illustrates an alternative drawbar trigger assembly embodiment.
Figure 18:
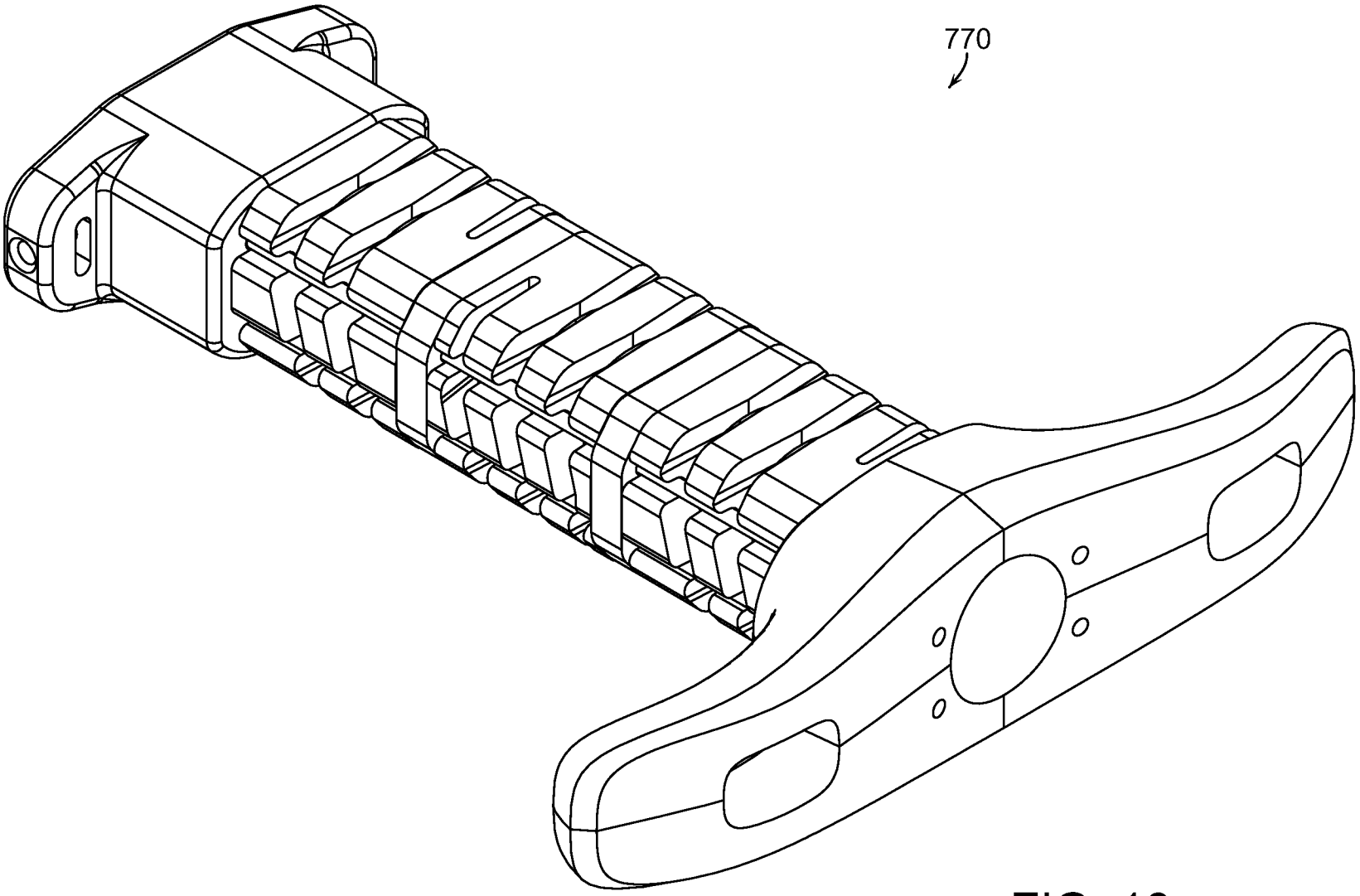
FIG. 18 illustrates an alternative helix bead trigger assembly embodiment.

Reference is next made to FIGS. 13-18, which illustrate alternative embodiments of a trigger assembly 170/270/370/470/570/670/770. FIG. 13 illustrates an alternative 2-way bead trigger assembly embodiment, designated generally as 270. Rather than use a single member flexible sleeve member, a plurality of beads may be stacked between the trigger and the coupling member. The beads may include a medial internal recess for the stem and a plurality of internal recesses for the stem cables. The external shapes of the beads may also be configured to facilitate both inter-nesting and lateral flexibility. In this embodiment, the trigger wires 174 are fixably coupled to 172 and 176. In the retracted state, the spring puts the column of interlocking beads in compression and resists bending. In the extended state, the trigger assembly is made to intentionally buckle when the stem is flexed. During this intentional buckling, the trigger 176 rotates 90 degrees. FIG. 14 illustrates an alternative 3-way bead trigger assembly embodiment, designated generally as 370. Similarly, the 3-way bead trigger assembly embodiment may include internal recesses for three trigger cables and specific external shapes for inter-nesting and lateral flexibility. In this embodiment, the three trigger cables are spaced 120 degrees radially apart and provide rigidity along the three planes though the axes of the trigger cables when in the retracted state. FIG. 15 illustrates an alternative 4-way trigger assembly embodiment, designated generally as 470. In this 4-way embodiment, the four cables are spaced 90 degrees radially apart and provide rigidity along the two planes through the axes of the trigger cables when in the retracted state. FIG. 16 illustrates an alternative double helix trigger assembly embodiment, designated generally as 570. This embodiment is essentially the same as the embodiments shown in FIGS. 1-12, except 178 is comprised of two pieces. The two 178 elements are nested inside of each other. They are two helixes nested out of phase with each other. This is done to avoid some of the challenges in the manufacture of 178. FIG. 17 illustrates an alternative drawbar trigger assembly embodiment, designated generally as 670. In this drawbar assembly embodiment, the cables are routed inside of the beads. The coupling member has two trigger cables fixed to it that pass through a distal ring and through the beads and are fixed to a proximal ring. The trigger has two trigger cables that pass through the proximal ring and through the beads and are fixed to the distal ring. When the trigger is pulled to achieve a retracted state, the springs in the cam lobes provide an opposite force on the coupling member. This in turn, puts the beads in compression and makes the trigger assembly resist bending. FIG. 18 illustrates an alternative helix bead trigger assembly embodiment, designated generally as 770. This embodiment is essentially the same as that which is shown in FIGS. 1-12, except 178 is comprised of 5 pieces. There are three helix pieces separated by two spacers. The spacers couple with the trigger cables to prevent buckling.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes a plurality of retractor wires and a trigger assembly, and wherein the trigger assembly is slidably externally coupled to a connection system;

wherein the trigger assembly comprises:

a coupling member coupled with the plurality of cam lobes via the plurality of retractor wires;

at least one trigger cable coupled to the coupling member;

a trigger coupled to the at least one trigger cable;

a sleeve member intercoupled between the coupling member and the trigger, wherein the at least one trigger cable is disposed within the sleeve member; and wherein the connection system is configured to create an elongated partially rigid region by intercoupling the head member with a loop.

2. The system of claim 1, wherein the at least one trigger cable includes a single cable with a first and a second end, wherein the first and second end are fixably coupled to the coupling member and the trigger cable is slidably coupled to the trigger.

3. The system of claim 1, wherein the at least one trigger cable includes two trigger cables each of which are fixably coupled on one end to the coupling member and slidably coupled on the other end to the trigger.

4. The system of claim 1, wherein the at least one trigger cable includes two trigger cables each of which are releasably coupled on one end to the coupling member and slidably coupled on the other end to the trigger.

5. The system of claim 1, wherein the trigger assembly is disposed between the loop and the head member.

6. The system of claim 1, wherein the plurality of cam lobes are independently coupled to one of the plurality of retraction wires.

7. The system of claim 1, wherein the coupling member is releasably coupled with the plurality of retraction wires.

8. The system of claim 1, wherein the at least one trigger cable is releasably coupled with the coupling member.

9. The system of claim 1, wherein the sleeve member includes a helical slit pattern.

10. The system of claim 1, wherein the sleeve member comprises a flexible hollow member.

11. The system of claim 1, wherein the coupling between the trigger, coupling member, and cam lobes increases the rigidity of the elongated partially rigid region in the retracted state.

12. The system of claim 1, wherein the connection system includes a cable coupled at both ends to the head member.

13. The system of claim 12, wherein the cable forms the loop of the connection system.

14. The system of claim 1, wherein the trigger includes a first and a second end, and wherein the first and second end are independently coupled to the coupling member via the at least one trigger cable.

15. The system of claim 1, wherein the plurality of cam lobes includes four cam lobes.

16. The system of claim 1, wherein the plurality of cam lobes includes three cam lobes.

17. The system of claim 1, wherein the at least one axle includes two axles.

18. The system of claim 1, wherein the at least one axle includes one axle.

19. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes a plurality of retractor wires and a trigger assembly, and wherein the trigger assembly is slidably externally coupled to a connection system;

wherein the trigger assembly comprises:

a coupling member coupled with the plurality of cam lobes via the plurality of retractor wires;

at least one trigger cable coupled to the coupling member;

a trigger coupled to the at least one trigger cable;

a sleeve member intercoupled between the coupling member and the trigger, wherein the at least one trigger cable is disposed within the sleeve member;

wherein the at least one trigger cable includes a single cable with a first and second end, wherein the first and second end are fixably coupled to the coupling member and the trigger cable is slidably coupled to the trigger; and wherein the connection system is configured to create an elongated partially rigid region by intercoupling the head member with a loop.

20. An active camming device system comprising:

a head member comprising at least one axle;

a plurality of cam lobes rotatably coupled to the at least one axle, wherein the plurality of cam lobes are rotatable between an extended state and a retracted state with respect to the at least one axle, and wherein the cam lobes are spring biased toward the extended state;

a retraction system configured to selectively engage the retracted state, wherein the retraction system includes a plurality of retractor wires and a trigger assembly, and wherein the trigger assembly is slidably externally coupled to a connection system;

wherein the trigger assembly comprises:

a coupling member coupled with the plurality of cam lobes via the plurality of retractor wires;

at least one trigger cable coupled to the coupling member;

a trigger coupled to the at least one trigger cable;

a sleeve member intercoupled between the coupling member and the trigger, wherein the at least one trigger cable is disposed within the sleeve member; and wherein the connection system is configured to create an elongated partially rigid region by intercoupling the head member with a loop, and wherein the trigger assembly is disposed between the loop and the head member.

* * * * *